US011969070B2

(12) United States Patent
Yan et al.

(10) Patent No.: US 11,969,070 B2
(45) Date of Patent: Apr. 30, 2024

(54) COSMETIC PRODUCT CONTAINER AND RETENTION MECHANISM

(71) Applicant: ELC MANAGEMENT LLC, Melville, NY (US)

(72) Inventors: Jian Yan, Kirkland (CA); Miguel Alberto Herrera, Doylestown, PA (US)

(73) Assignee: ELC MANAGEMENT LLC, Melville, NY (US)

( * ) Notice: Subject to any disclaimer, the term of this patent is extended or adjusted under 35 U.S.C. 154(b) by 89 days.

(21) Appl. No.: 17/892,358

(22) Filed: Aug. 22, 2022

(65) Prior Publication Data

US 2024/0057743 A1 Feb. 22, 2024

(51) Int. Cl.

| | |
|---|---|
| ***A45D 40/00*** | (2006.01) |
| ***A45D 40/02*** | (2006.01) |
| ***A45D 40/12*** | (2006.01) |

(52) U.S. Cl.

CPC ..... *A45D 40/023* (2013.01); *A45D 40/12* (2013.01); *A45D 2040/0062* (2013.01)

(58) Field of Classification Search

CPC ..... A45D 40/02; A45D 40/023; A45D 40/04; A45D 40/06; A45D 40/065; A45D 2040/0062

See application file for complete search history.

(56) References Cited

U.S. PATENT DOCUMENTS

| | | | | |
|---|---|---|---|---|
| 5,865,550 | A | 2/1999 | Bouix | |
| 9,820,550 | B2 | 11/2017 | Heraud | |
| 11,700,929 | B1 * | 7/2023 | Bourguignat | A45D 34/04 401/118 |

(Continued)

FOREIGN PATENT DOCUMENTS

| | | | |
|---|---|---|---|
| CN | 111543769 | A | 8/2020 |
| CN | 211510835 | U | 9/2020 |
| EP | 0894453 | A2 | 2/1999 |

(Continued)

OTHER PUBLICATIONS

International Application No. PCT/US2023/028730, International Search Report and Written Opinion, dated Nov. 15, 2023.

(Continued)

*Primary Examiner* — Jennifer C Chiang
(74) *Attorney, Agent, or Firm* — MARSHALL, GERSTEIN & BORUN LLP

(57) ABSTRACT

A cosmetic product container and retention mechanism include a cup including a cup body and a ring and a cosmetic substance. The cup body has first and second ends and an inner sidewall forming a cup cavity. The inner sidewall includes a first positioning notch. The ring is at least partially disposed within the cup cavity adjacent to the first positioning notch and includes an inner ring surface and defines a ring cavity. The ring is constructed from a compressible material that is positionable in a first, expanded configuration and a second, compressed configuration. The cosmetic substance has first and second ends and an elongated body therebetween. At least a portion of the elongated body is disposed within the ring cavity. Upon disposing at least a portion of the cosmetic substance within the ring cavity, the ring is adapted to apply a retaining force thereto.

20 Claims, 9 Drawing Sheets

(56) References Cited

U.S. PATENT DOCUMENTS

| | | | |
|---|---|---|---|
| 2013/0075301 | A1 | 3/2013 | McLaughlin |
| 2018/0070703 | A1 | 3/2018 | Kikuchi et al. |

FOREIGN PATENT DOCUMENTS

| | | | |
|---|---|---|---|
| FR | 3074023 | A1 | 5/2019 |
| JP | 2013180037 | A | 9/2013 |
| JP | 2017136307 | A | 8/2017 |
| WO | WO-2014001762 | A1 | 1/2014 |

OTHER PUBLICATIONS

International Application No. PCT/US2023/028736, International Search Report and Written Opinion, dated Nov. 16, 2023.

* cited by examiner

COSMETIC PRODUCT CONTAINER AND RETENTION MECHANISM

FIELD OF THE DISCLOSURE

The present disclosure generally relates to cosmetic, hair care, body care, and/or skincare products and, more particularly, to systems and approaches for containing and retaining such products.

BACKGROUND

Cosmetic, hair care, body care, and/or skincare products may be provided in a number of different containers, and may be applied using a number of varying approaches. As an example, a lipstick or lip balm product may be in the form of an elongated tube or cylinder that is disposed in a protective container. Such containers may allow the cosmetic substance to selectively advance to an extended position relative to the container to be applied by the user. The cosmetic substance may be a generally solid, yet relatively soft, molded composition that may be inserted into a cavity of a retaining cup. In the event the container is inadvertently dropped or otherwise jostled, the cosmetic substance may become damaged, broken, or otherwise detached from the retaining cup. In some examples, the retaining cup (or other features of the container) may include discrete retention members in the form of hooks, elongated ribs, or similar components that may be urged into the cosmetic substance in an attempt to prevent or otherwise limit movement of the cosmetic substance relative to the cup and the container during these inadvertent drops or bumps. However, these features may create localized stress points that may ultimately deform or otherwise damage the cosmetic substance.

Accordingly, there is a need for improved accessories having improved functionalities.

SUMMARY

Examples within the scope of the present disclosure are directed to a cosmetic product container and retention mechanism that may include a cup including a cup body and a ring and a cosmetic substance. The cup body has first and second ends and an inner sidewall forming a cup cavity. The inner sidewall includes a first positioning notch. The ring is at least partially disposed within the cup cavity adjacent to the first positioning notch and includes an inner ring surface and defines a ring cavity. The ring is constructed from a compressible material that is positionable in a first, expanded configuration and a second, compressed configuration. The cosmetic substance has first and second ends and an elongated body therebetween. At least a portion of the elongated body is disposed within the ring cavity. Upon disposing at least a portion of the cosmetic substance within the ring cavity, the ring is adapted to apply a retaining force thereto.

In some examples, when the ring is in the first, expanded configuration, the ring defines an expanded inner cross-sectional dimension, and when the ring is in the second, compressed configuration, the ring defines a compressed inner cross-sectional dimension. Further, the elongated body of the cosmetic substance has an outer cross-sectional dimension that is greater than the expanded inner cross-sectional dimension.

In some approaches, the compressible material comprises at least one of a plasticizer-free thermoplastic polyester elastomer (TPE), thermoplastic polyurethane (TPU), or a copolyester elastomer. In these and other approaches, the compressed inner cross-sectional dimension is between approximately 1.005 and approximately 1.5 times larger than the expanded inner cross-sectional dimension.

In some aspects, the cosmetic product may further include an outer container having a first end and a second end and defining a container cavity. The cup may be at least partially disposed within the container cavity. Further, in some examples, the cup body may include a second positioning notch formed from a resilient material. The second positioning notch may deform to allow the ring to be positioned adjacent to the first and second positioning notches. Further, the second positioning notch may apply an urging force towards the cup cavity upon inserting the cup into the container cavity.

In some forms, the ring may surround an entire outer circumferential section of the cosmetic substance. In these and other forms, a cup retention member may be provided that is disposed on an outer surface of the cup body. The cup retention member may be aligned with the ring.

In some examples, the ring may further include a floor member. The first end of the cosmetic substance may abut the floor member.

In accordance with a second aspect, a cup for retaining a cosmetic substance is provided that includes a cup body having a first end, a second end, and an inner sidewall forming a cup cavity and a ring. The inner sidewall of the cup body may include a first positioning notch. The ring is at least partially disposed within the cup cavity adjacent to the first positioning notch. The ring includes a ring inner surface and defines a ring cavity. The ring is constructed from a compressible material that is positionable in a first, expanded configuration and a second, compressed configuration. The ring may apply a retaining force to on the cosmetic substance when in the expanded configuration to retain the cosmetic substance within the ring cavity.

In accordance with a third aspect, a method of assembling a cosmetic product includes providing a cup including a cup body having a first end, a second end, and an inner sidewall forming a cup cavity, the inner sidewall including a first positioning notch and at least partially disposing a ring within the cup cavity adjacent to the first positioning notch. The ring includes a ring inner surface, defines a ring cavity, and is constructed from a compressible material that is positionable in a first, expanded configuration whereby the ring defines an expanded inner cross-sectional dimension and a second, compressed configuration whereby the ring defines a compressed inner cross-sectional dimension.

In some examples, the ring is then positioned in the second, compressed configuration, and at least a portion of an elongated body of a cosmetic substance is disposed within the ring cavity. The cosmetic substance has a first and second end and an elongated body extending therebetween. Subsequent to disposing the at least a portion of the elongated body of the cosmetic substance within the ring, the ring moves to the first, expanded configuration, thereby applying a retaining force to the cosmetic substance.

BRIEF DESCRIPTION OF THE DRAWINGS

The above needs are at least partially met through provision of one, more than one, or any combination of the cosmetic product containers and retention mechanisms described in the following detailed description, particularly when studied in conjunction with the drawings, wherein.

Figure 1:
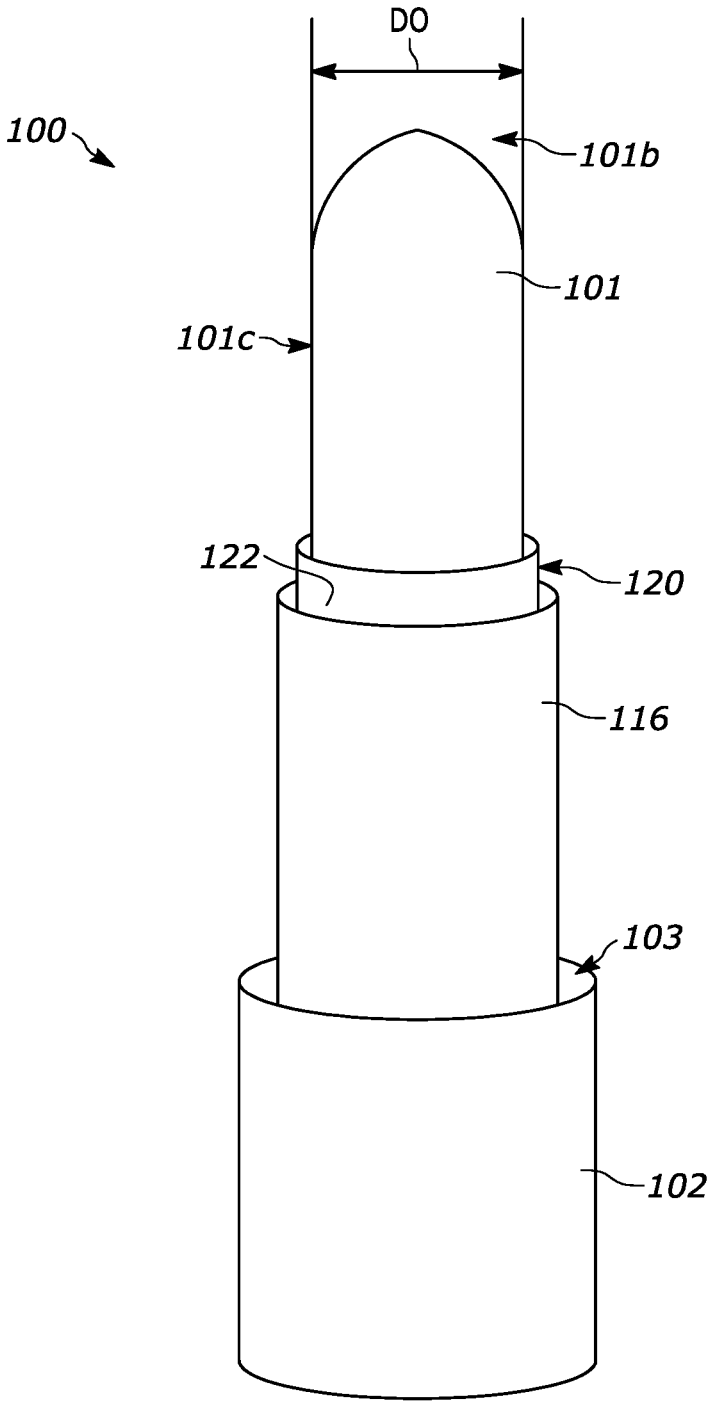
FIG. 1 illustrates a front elevation view of an example cosmetic product in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, cosmetic product containers and retention mechanisms are provided that adequately retain a cosmetic substance during use as well as in the event of inadvertent drops and/or bumps. The approaches described herein provide firm retention of the cosmetic substance while reducing or eliminating potentially harmful stress regions. As such, the systems described herein may be used to contain and retain a multitude of cosmetic substances having varying degrees of material softness.

Turning to the Figures, a cosmetic product 100 is provided for containing and applying a cosmetic substance 101. The cosmetic product 100 includes a base 102, a track 108, an inner body 112, a shell 116, and a retention mechanism 120. In the illustrated examples, the cosmetic substance 101 is in the form of a lipstick or lip balm product. It is to be appreciated that the cosmetic substance 101 may be any type of cosmetic, hair care, body care, and/or skincare product that may be applied to a user. Other examples are possible. In some of these examples, the cosmetic substance 101 may include strong or otherwise aggressive chemicals and/or solvents such as, for example, volatiles. The cosmetic substance 101 includes a first end 101*a*, a second end 101*b*, and an elongated body 101*c* extending therebetween along a longitudinal axis ("A"). Further, the cosmetic substance 101 defines an outer cross-sectional dimension ("DO"). In the illustrated examples, the outer cross-sectional dimension DO is in the form of an outer diameter or circumference. However, other examples are possible.

Generally speaking, the base 102 at least partially retains components of the cosmetic product 100 in a base cavity 103. The base cavity 103 defines a ledge 104 formed on an inner surface, and further includes a securement mechanism 105 formed on an outer surface thereof. The securement mechanism 105 may be used to engage a portion of a cap (not illustrated) to conceal the cosmetic substance 101 for storage purposes. Any number of suitable securement mechanisms 105 may be used such as, for example, a friction-fit coupling, a threaded connection, and the like. Other examples are possible.

The track 108 is at least partially disposed within the base cavity 103 and includes a first end 108*a* and a second end 108*b* and defines a channel 109. The inner body (which, in some examples, may be referred to as an outer container) 112 is at least partially disposed within the base cavity 103 and includes an inner surface 113 and a notch 114. The shell 116 is also at least partially disposed within the base cavity 103 and is provided to prevent a user from observing these components. The shell 116 includes a lip 117 that engages a portion of the inner body 112 to restrict movement in a direction along the longitudinal axis A. It is to be appreciated that any of the base 102, the track 108, the inner body 112, and/or the shell 116 may include any number of additional features and/or components to assist in use of the cosmetic product 100, but for the sake of brevity, such features and/or components will not be discussed in substantial detail herein.

The retention mechanism 120 is provided to securely retain the cosmetic substance 101. The retention mechanism 120 includes a cup 122 having a cup body 124 and a ring 134. The cup body 124 includes a first end 124*a*, a second end 124*b*, an inner sidewall 124*c*, and a cup cavity 125. Generally speaking, the cosmetic substance 101 is at least partially disposed within the cup cavity 125. The cup body 124 further includes a first positioning notch 126, a second positioning notch 128, and a cup retention member 130. In some examples, the first positioning notch 126 is relatively rigid and/or inflexible. Further, in some examples and as illustrated in FIGS. 3-9, the second positioning notch 128 is bendable, pivotable, or otherwise flexible about a base region 128*a*. The second positioning notch 128 further includes a bump 129.

Figure 3:
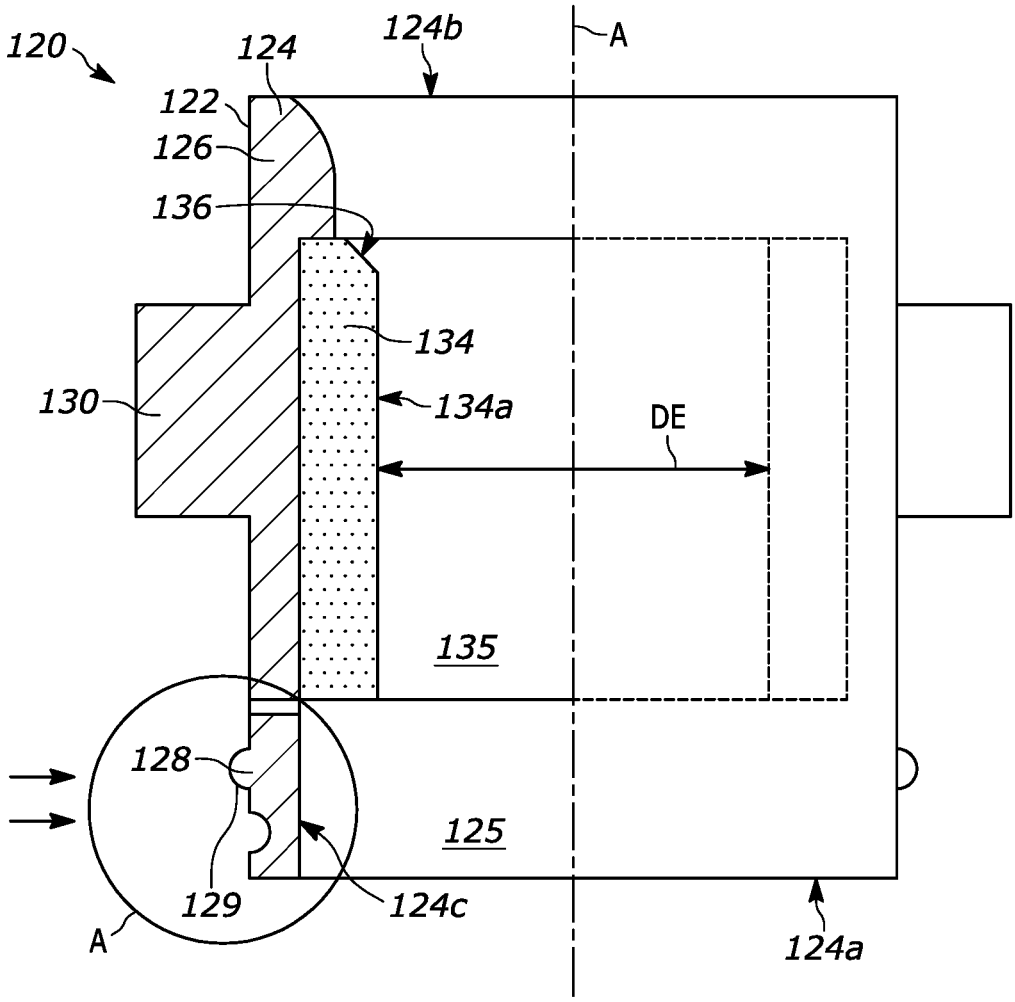
FIG. 3 illustrates a partial cross-sectional side elevation view of the example retention mechanism of FIGS. 1 & 2 in accordance with various examples.
Figure 4:
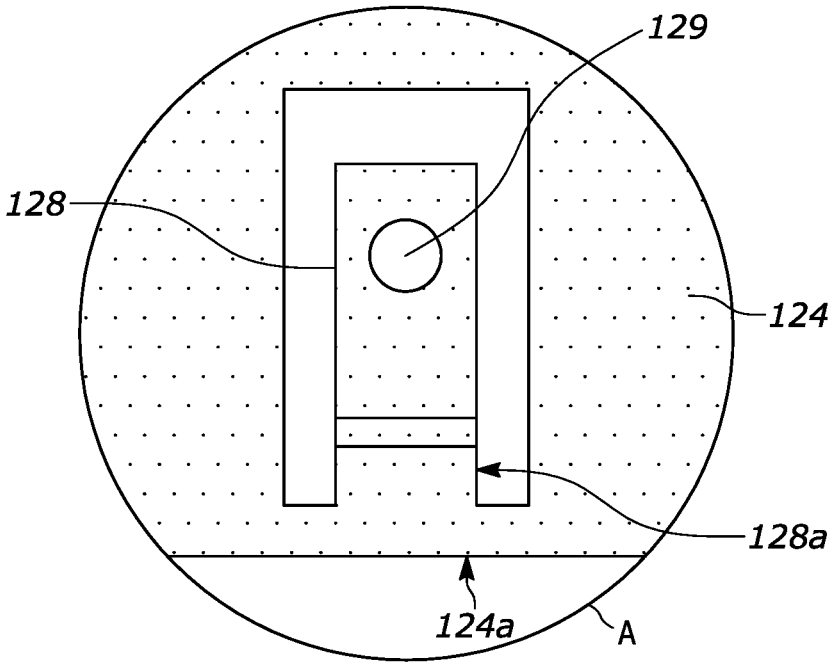
FIG. 4 illustrates a side cross-sectional view of a portion of the example retention mechanism of FIG. 3 in accordance with various examples.
Figure 5:
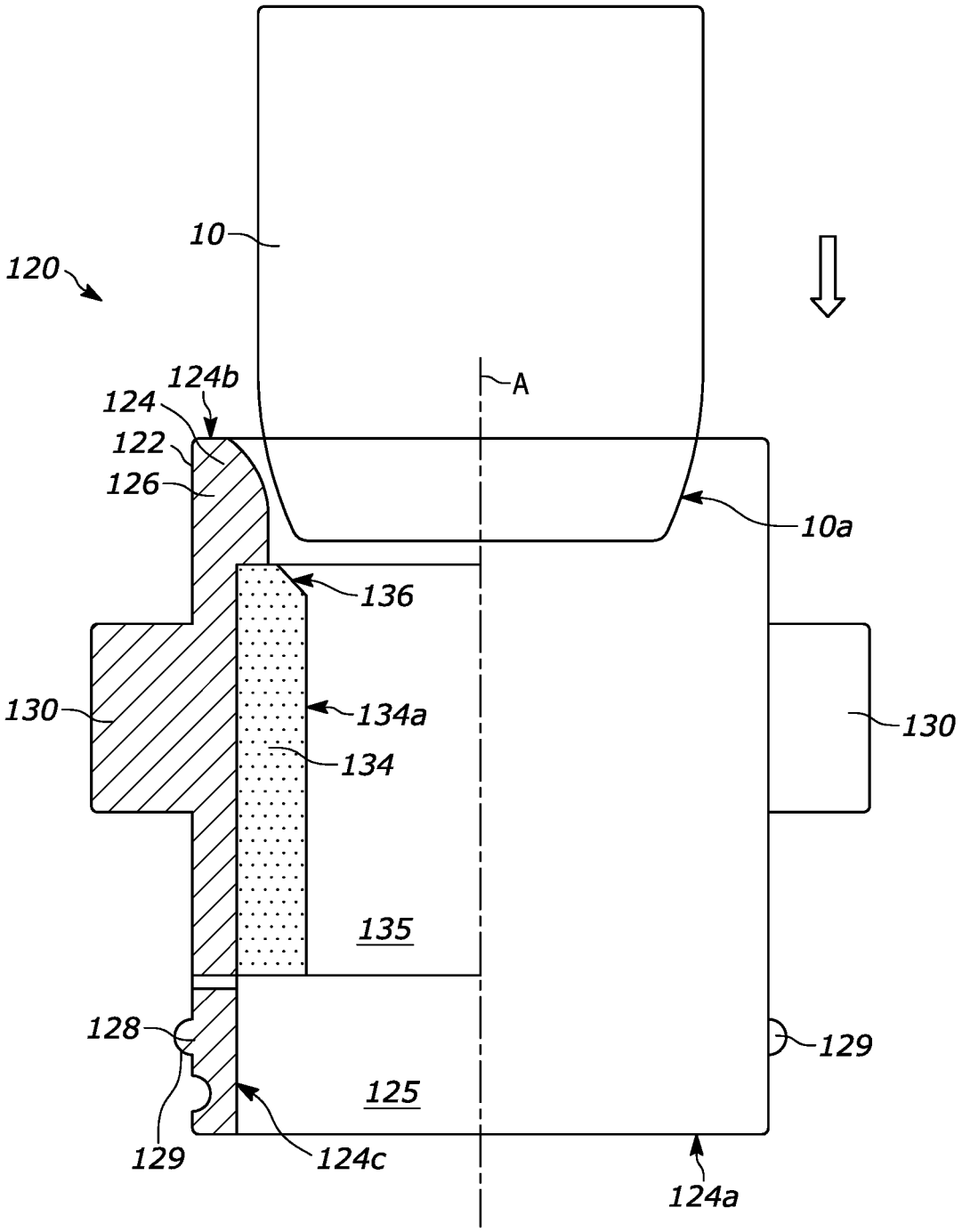
FIG. 5 illustrates a partial cross-sectional side elevation view of the example retention mechanism of FIGS. 1-4 prior to compression in accordance with various examples.
Figure 9:
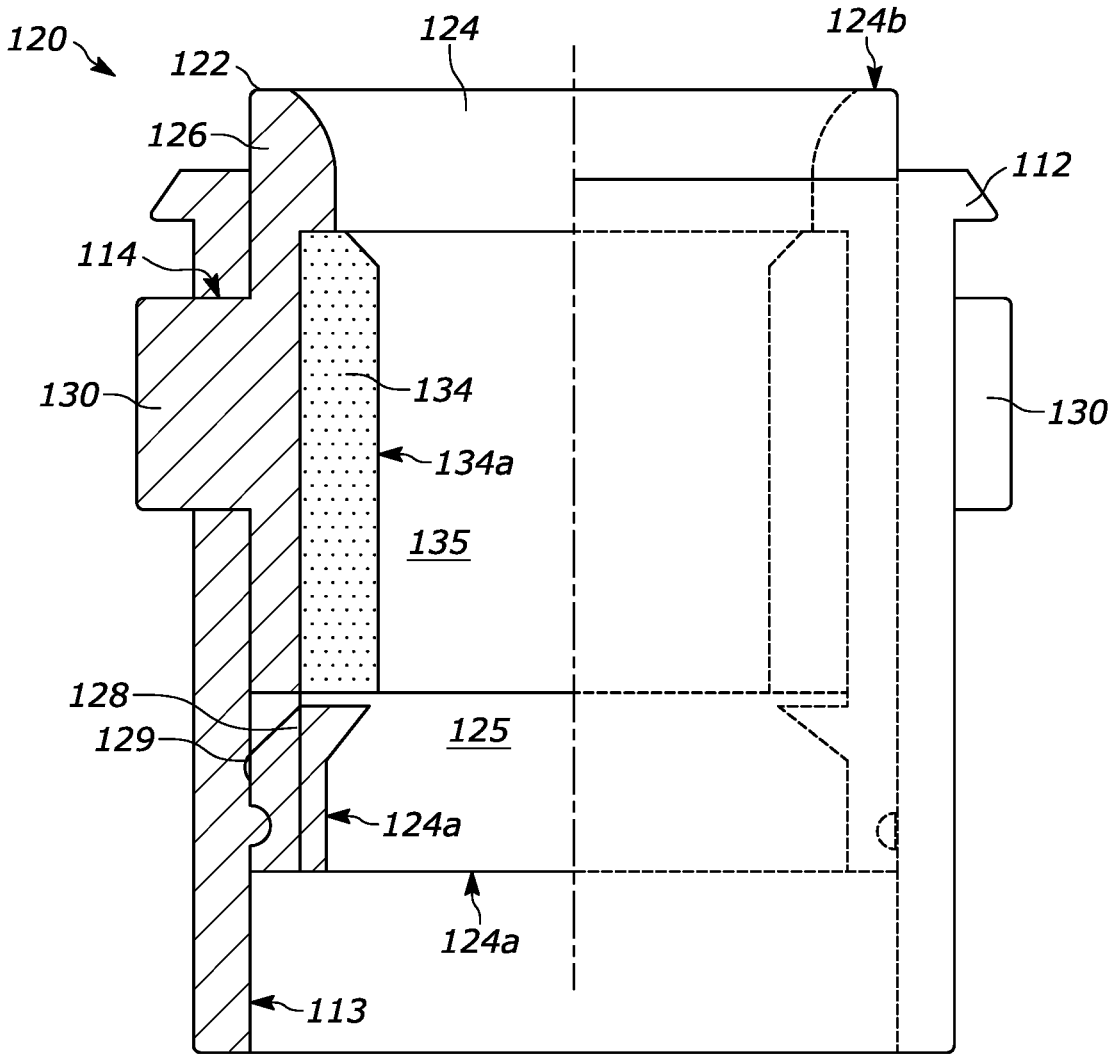
FIG. 9 illustrates a partial cross-sectional side elevation view of the example retention mechanism of FIGS. 1-8 upon coupling the retention mechanism to an inner body in accordance with various examples.

With reference to FIGS. 3, 4, and 9, the second positioning notch 128 is adapted to selectively engage the inner body 112. More specifically, upon disposing the cup body 124 within the inner body 112, the inner surface 113 of the inner body 112 contacts the bump 129 of the second positioning notch 128 and causes the second positioning notch 128 to rotate or pivot inwardly about the base region 128*a*. Upon coupling the cup body 124 with the inner body 112, the cup retention member 130 is positioned within the notch 114 of the inner body 112 to prevent or otherwise limit relative movement between the inner body 112 and the cup body 124. So arranged, both the first and second positioning notches 126, 128 extend inwardly into the cup cavity 125.

The ring 134 is at least partially positioned within the cup cavity 125 and includes a ring inner surface 134*a* and defines a ring cavity 135. As illustrated in FIGS. 2, 3, and 4-9, the ring 134 is positionable adjacent to or near the first positioning notch 126 of the cup body 124, which assists in preventing the ring 134 from advancing in a direction along the longitudinal axis A. The ring 134 is constructed from a compressible or otherwise flexible material that is capable of providing adequate support to the cosmetic substance 101. In some examples, the ring 134 may be constructed from a plasticizer-free thermoplastic polyester elastomer (TPE), thermoplastic polyurethane (TPU), or a copolyester elastomer. Other examples are possible. In any of these examples, the ring 134 is positionable in a first, expanded configuration (e.g., FIGS. 3 & 5) and a second, compressed configuration (e.g., FIGS. 6 & 7).

Figure 6:
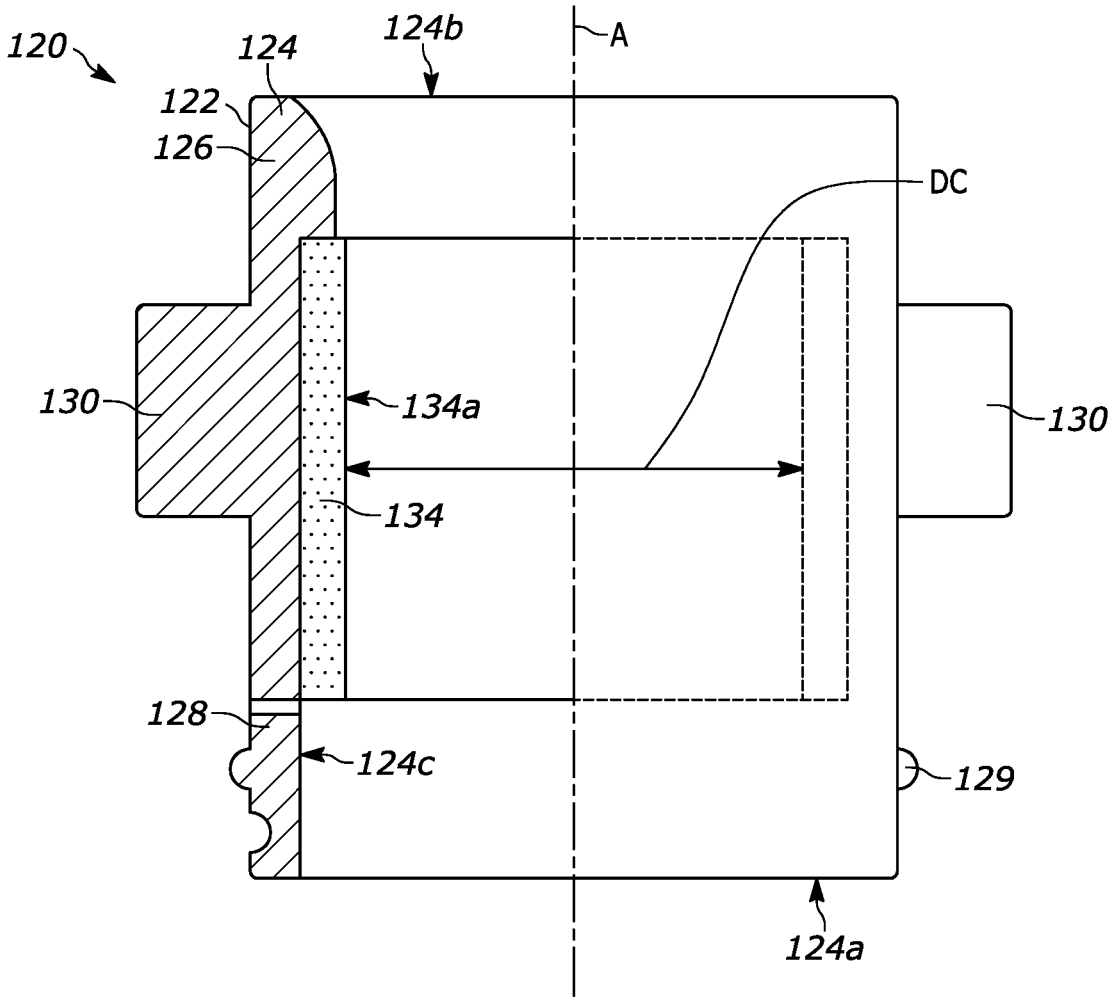
FIG. 6 illustrates a partial cross-sectional side elevation view of the example retention mechanism of FIGS. 1-5 after compression in accordance with various examples.

When the ring 134 is positioned in the first, expanded position, the ring 134 defines an expanded inner cross-sectional dimension DE (FIG. 3). Further, when the ring 134 is positioned in the second, compressed position, the ring 134 defines a compressed inner cross-sectional dimension DC (FIG. 6). In some examples, the compressed inner cross-sectional dimension DC is between approximately 1.005 and approximately 1.5 times larger than the expanded inner cross-sectional dimension DE. Other examples are possible. In some examples, upon being compressed, the ring 134 may fully expand and return to the first, expanded position after approximately 20 seconds. It is to be appreciated that this return time may be greater or lesser depending on the desired performance, strength, and/or material composition of the ring 134 and to allow the cosmetic substance 101 to be properly and fully inserted into the ring cavity 135. As a non-limiting example, the ring 134 may have a mean density that is foamed to as low as approximately 0.2 g/cm 3 and a resistance of up to 80%.

With reference to FIGS. 3-9, to assemble the retention mechanism 120 and the cosmetic product 100, the ring 134 is inserted into the cup cavity 125 and positioned adjacent to the first positioning notch 126. In some examples, the ring 134 is inserted at the first end 124*a* of the cup body 124 towards the second end 124*b* thereof. In some approaches, the cup body 124 may then be coupled with the inner body 112 to cause the second positioning notch 128 to extend inwardly into the cup cavity 125, thereby retaining the ring 134 in a relatively fixed position with respect to the longitudinal axis A (FIG. 9). However, in other examples, the cup body 124 may not be coupled with the inner body 112 at this point.

With reference to FIGS. 5-9, a compressing tool 10 such as a rod may be inserted into the second end 124*b* of the cup body 124. In the illustrated example, both the compressing tool 10 and the ring included angled or chamfered leading edges 10*a*, 136, respectively, to allow the compressing tool 10 to be inserted into the ring cavity 135 of the ring 134. Upon moving the compressing tool 10 along the longitudinal axis A in a direction towards the first end 124*a* of the cup body 124, the ring 134 compresses to the compressed position whereby the ring inner surface 134*a* defines the compressed inner cross-sectional dimension DC upon removing the compressing tool 10 (FIG. 6).

Figure 7:
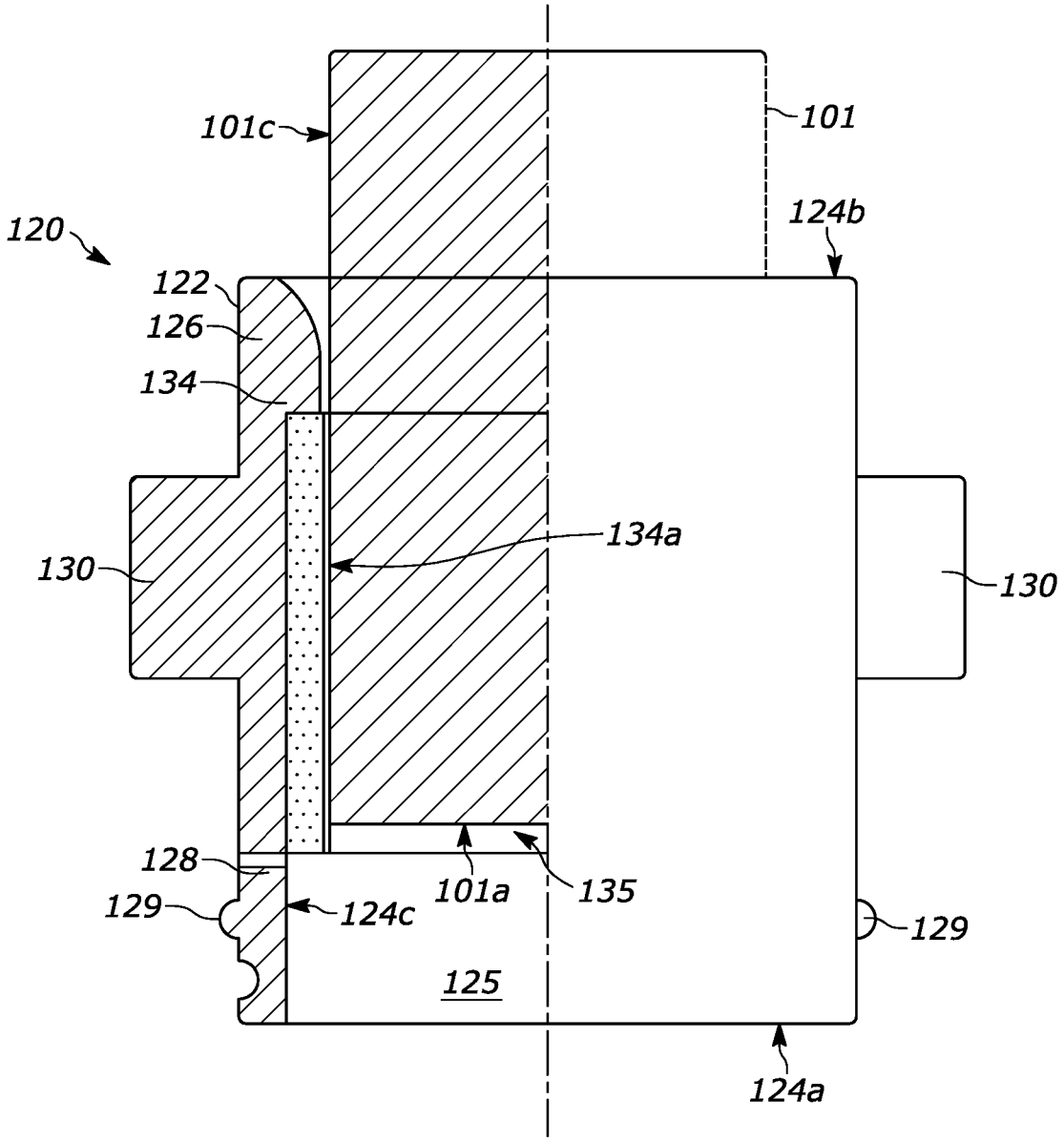
FIG. 7 illustrates a partial cross-sectional side elevation view of the example retention mechanism of FIGS. 1-8 after insertion of a cosmetic substance in accordance with various examples.
Figure 8:
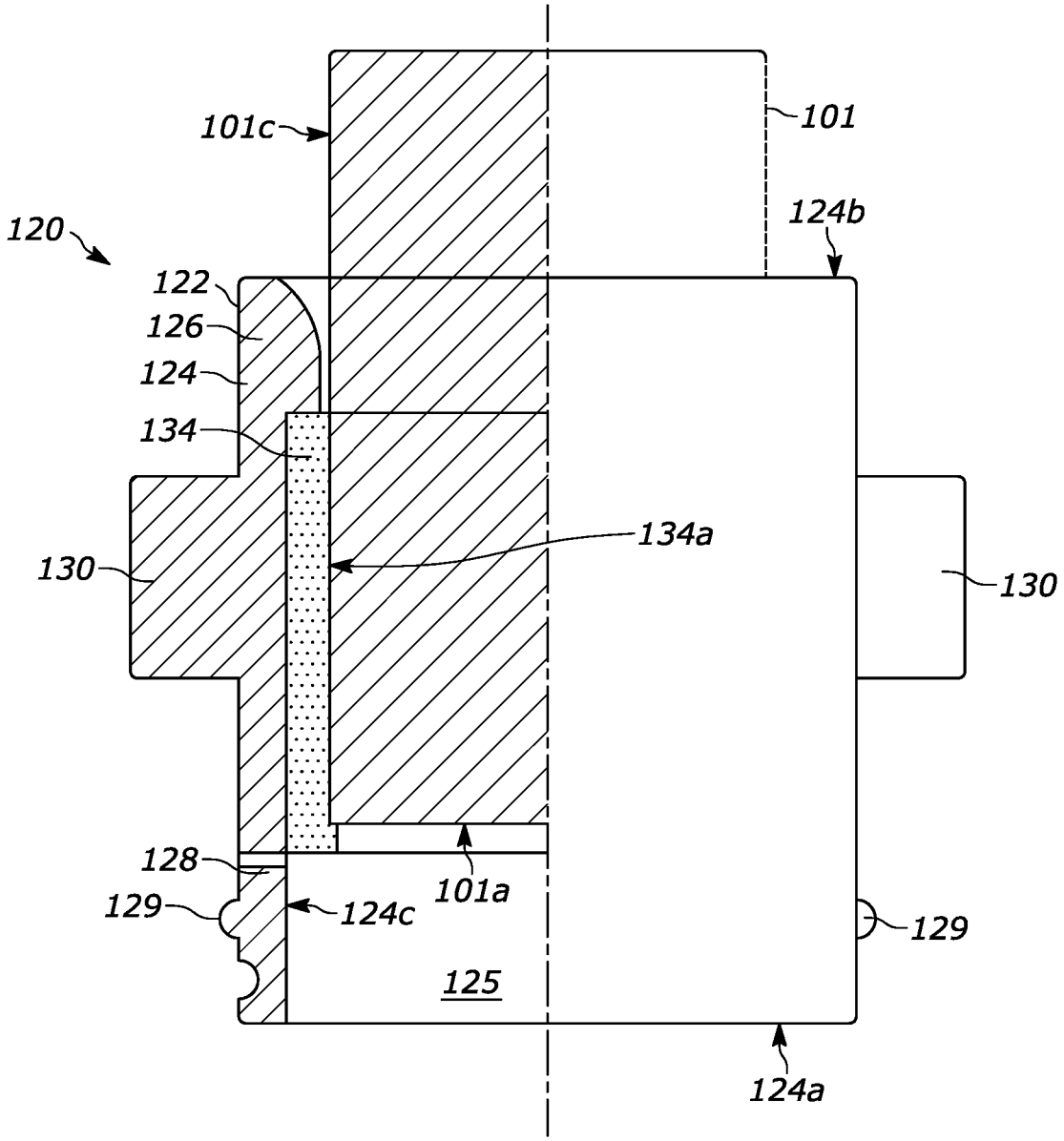
FIG. 8 illustrates a partial cross-sectional side elevation view of the example retention mechanism of FIGS. 1-7 after insertion of the cosmetic substance and after expansion in accordance with various examples.

As illustrated in FIG. 7, the first end 101*a* of the cosmetic substance 101 is then inserted into the cup cavity 125 and the (compressed) ring cavity 135. Because the compressed inner cross-sectional dimension DC is greater than the outer cross-sectional dimension DO of the cosmetic substance 101, the cosmetic substance 101 may be inserted into the ring cavity 135. As illustrated in FIG. 8, after a predetermined time and depending on material properties of the ring 134, the ring expands to the expanded inner cross-sectional dimension DE which is smaller than the outer cross-sectional dimension DO. Accordingly, the ring inner surface 134*a* applies a retaining force that squeezes or compresses against the elongated body 101*c* of the cosmetic substance 101. In some examples, the outer cross-sectional dimension DO is significantly (e.g., more than 5%) larger than the expanded inner cross-sectional dimension DE. Such an arrangement may ensure the ring 134 applies a compressive or retaining force against the cosmetic substance 101 when disposed therein. The compressibility of the ring 134 described herein advantageously provides more retaining force than a system using a rigid or otherwise inflexible ring having a smaller dimension than that of the cosmetic substance 101. Further, such a rigid or otherwise inflexible ring having a smaller dimension than that of the cosmetic substance 101 would inherently damage or otherwise deform at least a portion of the cosmetic substance 101 upon being disposed within the ring.

It is to be appreciated that in some examples, the ring 134 may not expand fully to the first, expanded configuration when the cosmetic substance 101 is disposed within the ring cavity 135. However, in such examples, the ring 134 will still apply a suitable retaining and/or compressive force on the cosmetic substance 101.

Depending on the material composition of the cosmetic substance 101, the ring 134 may be formed from specific materials and/or have other dimensions or characteristics allowing it to apply a relatively gentle or relatively firm compressive force against the cosmetic substance 101 without causing damage or deformation along the elongated body 101*c* due to the significant surface area contact between the ring 134 and the elongated body 101*c*.

While the illustrated examples depict the ring 134 as encompassing or otherwise encircling an entire outer circumferential section of the elongated body 101*c* of the cosmetic substance 101, in some examples, the ring 134 may only encompass a portion of the entire outer circumferential section. Further, it is to be appreciated that if the cosmetic substance 101 is provided in other cross-sectional shapes (e.g., non-circular cross-sectional shapes), the ring 134 may have a similar non-circular cross-sectional shape. Further still, it is to be appreciated that in some examples, any of the steps described herein may be performed on the opposite or inverted end of the product 100. For example, the ring 134 may be inserted at the second end 124*b* of the cup body 124, the compressing tool 10 may be inserted at the first end 124*a* of the cup body 124, and so on.

Figure 2:
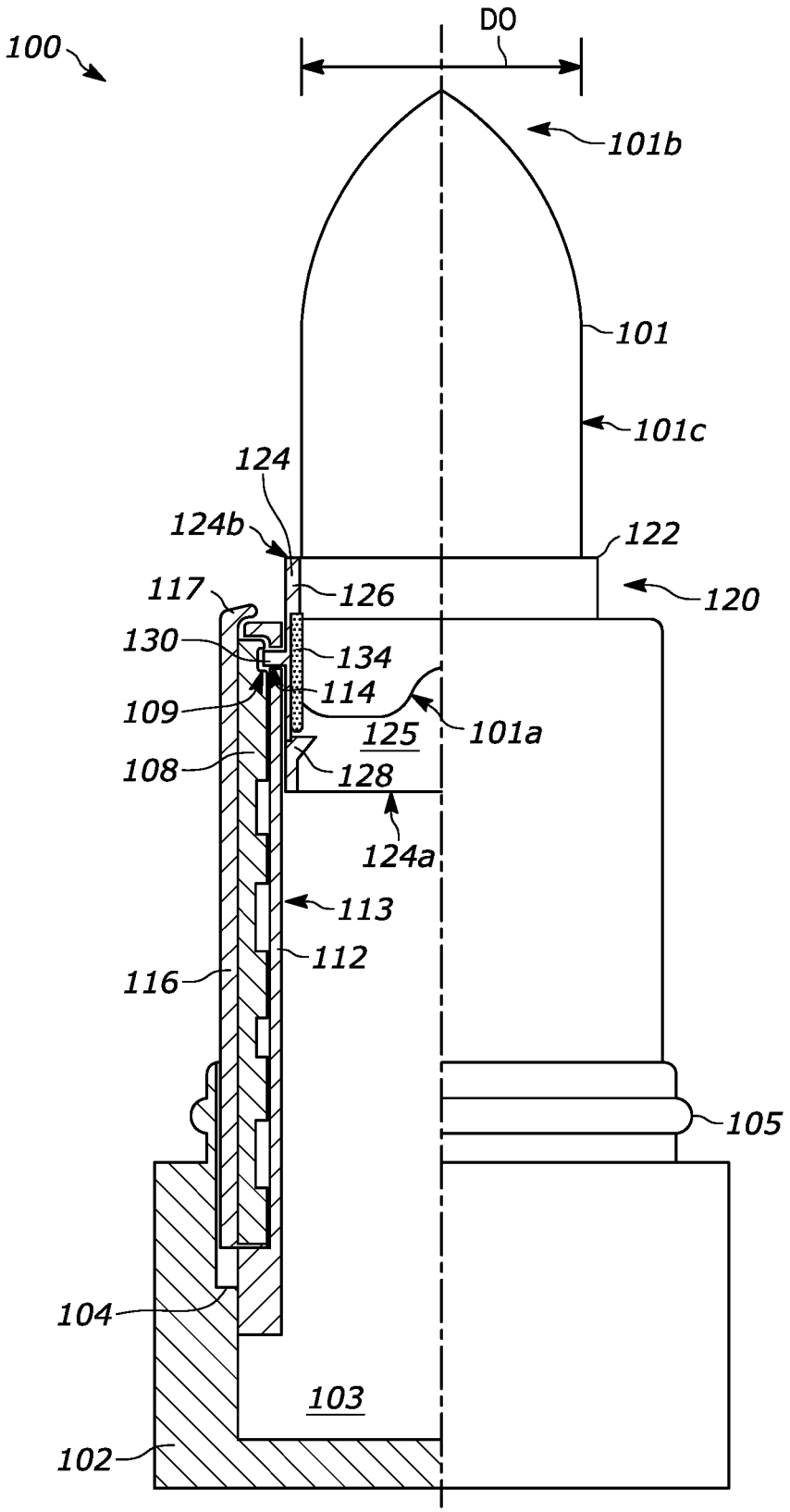
FIG. 2 illustrates a partial cross-sectional front elevation view of the example cosmetic product of FIG. 1 having an example retention mechanism in accordance with various examples.

With reference to FIG. 2, upon assembling the retention mechanism and the inner body 112, the cup retention member 130 (which, in some examples protrudes outwardly from the notch 114 of the inner body 112 is inserted into the channel 109 of the track 108. The lip 117 of the shell 116 may then be positioned over the inner body 112, and these components may then be inserted into the base cavity 103 of the base 102 until the shell 116 engages the ledge 104. In some examples, the shell 116, the track 108, and/or the inner body 112 may be fixed relative to the base 102 while the cup 122 may be rotatable relative thereto. As such, to advance the cosmetic substance 101, causing it to protrude outwardly beyond the shell 116, a user may twist the base to cause the cup retention member 130 to advance along the channel 109.

It is to be appreciated that the cosmetic product 100 may include any number of modifications. For example, in some approaches (not illustrated), the cup body 124 or the ring 134 may also include a floor member. Such a floor member may provide additional support for the first end 101*a* of the cosmetic substance 101. Further, in some examples (not illustrated) the inner sidewall 124*c* of the cup body 124 may include a channel or other locating mechanism to assist with alignment of the ring 134.

So configured, the retention mechanism and product described herein securely retains the cosmetic substance without damaging portions thereof. As previously noted, the retention mechanism may be modified based on the characteristics of the cosmetic substance to ensure an ideal retaining force is exerted thereon.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A cosmetic product comprising:

a cup including:

a cup body having a first end, a second end, and an inner sidewall forming a cup cavity, the inner sidewall including a first positioning notch;

a ring at least partially disposed within the cup cavity adjacent to the first positioning notch, the ring including a ring inner surface and defining a ring cavity, the ring being constructed from a compressible material that is positionable in a first, expanded configuration and a second, compressed configuration, and a cosmetic substance having a first end, a second end, and an elongated body therebetween, wherein at least a portion of the elongated body is adapted to be disposed within the ring cavity;

wherein upon disposing at least a portion of the cosmetic substance within the ring cavity, the ring is adapted to apply a retaining force thereto.

2. The cosmetic product of claim 1, wherein when the ring is in the first, expanded configuration, the ring defines an expanded inner cross-sectional dimension, when the ring is in the second, compressed configuration, the ring defines a compressed inner cross-sectional dimension, and the elongated body of the cosmetic substance has an outer cross-sectional dimension, wherein the outer cross-sectional dimension of the cosmetic substance is greater than the expanded inner cross-sectional dimension.

3. The cosmetic product of claim 1, wherein the compressible material comprises at least one of a plasticizer-free thermoplastic polyester elastomer (TPE), thermoplastic polyurethane (TPU), or a copolyester elastomer.

4. The cosmetic product of claim 1, wherein the compressed inner cross-sectional dimension is between approximately 1.005 and approximately 1.5 times larger than the expanded inner cross-sectional dimension.

5. The cosmetic product of claim 1, further comprising an outer container having a first end and a second end and defining a container cavity, wherein the cup is adapted to be at least partially disposed within the container cavity.

6. The cosmetic product of claim 5, wherein the cup body further includes a second positioning notch formed from a resilient material, the second positioning notch adapted to deform to allow the ring to be positioned adjacent to the first and second positioning notches.

7. The cosmetic product of claim 6, wherein the second positioning notch is adapted to apply an urging force towards the cup cavity upon inserting the cup into the container cavity.

8. The cosmetic product of claim 1, wherein the ring is adapted to surround an entire outer circumferential section of the cosmetic substance.

9. The cup of claim 1, further comprising a cup retention member disposed on an outer surface of the cup body, the cup retention member being aligned with the ring.

10. The cosmetic product of claim 1, wherein the ring further comprises a floor member, wherein the first end of the cosmetic substance is adapted to abut the floor member.

11. A retention mechanism for retaining a cosmetic substance, the retention mechanism comprising:

a cup body having a first end, a second end, and an inner sidewall forming a cup cavity, the inner sidewall including a first positioning notch;

a ring at least partially disposed within the cup cavity adjacent to the first positioning notch, the ring including a ring inner surface and defining a ring cavity, wherein the ring is constructed from a compressible material that is positionable in a first, expanded configuration and a second, compressed configuration;

wherein the ring is adapted to apply a retaining force on the cosmetic substance when in the expanded configuration to retain the cosmetic within the ring cavity.

12. The retention mechanism of claim 11, wherein when the ring is in the first, expanded configuration, the ring defines an expanded inner cross-sectional dimension and when the ring is in the second, compressed configuration, the ring defines a compressed inner cross-sectional dimension, the compressed inner cross-sectional dimension being larger than the expanded inner cross-sectional dimension.

13. The retention mechanism of claim 12, wherein the compressed inner cross-sectional dimension is between approximately 1.005 and approximately 1.5 times larger than the expanded inner cross-sectional dimension.

14. The retention mechanism of claim 11, wherein the compressible material comprises at least one of a plasticizer-free thermoplastic polyester elastomer (TPE), thermoplastic polyurethane (TPU), or a copolyester elastomer.

15. The retention mechanism of claim 11, further including a second positioning notch formed from a resilient material, the second positioning notch adapted to deform to allow the ring to be positioned adjacent to the first and second positioning notches.

16. The retention mechanism of claim 11, wherein the second positioning notch is adapted to apply an urging force towards the cup cavity.

17. The retention mechanism of claim 11, wherein the ring is adapted to surround an entire outer circumferential section of the cosmetic substance.

18. The retention mechanism of claim 11, wherein the ring further comprises a floor member.

19. A method of assembling a cosmetic product, the method comprising:

providing a cup including a cup body having a first end, a second end, and an inner sidewall forming a cup cavity, the inner sidewall including a first positioning notch; and at least partially disposing a ring within the cup cavity adjacent to the first positioning notch, the ring including a ring inner surface and defining a ring cavity, the ring being constructed from a compressible material that is positionable in a first, expanded configuration whereby the ring defines an expanded inner cross-sectional dimension and a second, compressed configuration whereby the ring defines a compressed inner cross-sectional dimension.

20. The method of claim 19, further comprising:

positioning the ring in the second, compressed configuration; and disposing at least a portion of an elongated body of a cosmetic substance within the ring cavity, the cosmetic substance further having a first end and a second end, the elongated body extending therebetween;

wherein subsequent to disposing the at least a portion of the elongated body of the cosmetic substance within the ring, the ring is adapted to move to the first, expanded configuration, thereby applying a retaining force to the cosmetic substance.

* * * * *